US012774865B2

(12) United States Patent
Snyman

(10) Patent No.: US 12,774,865 B2
(45) Date of Patent: Oct. 27, 2026

(54) TRIGGER DEVICE

(71) Applicant: Johan Hanno Snyman, Christchurch (NZ)

(72) Inventor: Johan Hanno Snyman, Christchurch (NZ)

( * ) Notice: Subject to any disclaimer, the term of this patent is extended or adjusted under 35 U.S.C. 154(b) by 0 days.

(21) Appl. No.: 18/921,289

(22) Filed: Oct. 21, 2024

(65) Prior Publication Data

US 2026/0110510 A1 Apr. 23, 2026

(51) Int. Cl.

| | |
|---|---|
| ***F41A 19/32*** | (2006.01) |
| ***F41A 17/46*** | (2006.01) |
| ***F41A 19/10*** | (2006.01) |
| ***F41A 19/16*** | (2006.01) |

(52) U.S. Cl.

CPC ..... *F41A 19/32* (2013.01); *F41A 17/46* (2013.01); *F41A 19/10* (2013.01); *F41A 19/16* (2013.01)

(58) Field of Classification Search

CPC ..... F41A 19/15; F41A 19/31; F41A 19/32; F41A 19/10; F41A 19/12; F41A 19/17; F41A 17/46

USPC ..... 42/69.01–69.2

See application file for complete search history.

(56) References Cited

U.S. PATENT DOCUMENTS

| | | | | |
|---|---|---|---|---|
| 2,514,981 | A | 7/1950 | Walker et al. | |
| 3,024,559 | A * | 3/1962 | Weatherby | F41A 19/15 42/70.06 |
| 3,950,876 | A * | 4/1976 | Wild | F41A 19/32 42/69.01 |
| 5,615,507 | A * | 4/1997 | French | F41A 17/56 42/69.02 |
| 5,752,338 | A * | 5/1998 | Lameiras Guede | F41A 17/46 42/70.06 |
| 8,631,600 | B2 | 1/2014 | Atzl | |
| 9,644,913 | B2 * | 5/2017 | Dextraze | F41A 19/10 |
| 10,352,640 | B2 | 7/2019 | Lipowski | |
| 10,801,795 | B2 | 10/2020 | Lipowski | |
| 11,199,373 | B1 * | 12/2021 | Watkins | F41A 19/12 |
| 2005/0183311 | A1 * | 8/2005 | Diaz | F41A 19/16 42/69.01 |

FOREIGN PATENT DOCUMENTS

| | | | | |
|---|---|---|---|---|
| DE | 20101250 U1 * | 5/2001 | | F41A 19/31 |

* cited by examiner

*Primary Examiner* — Reginald S Tillman, Jr.
(74) *Attorney, Agent, or Firm* — Leason Ellis LLP

(57) ABSTRACT

A trigger device for mounting with a firearm receiver containing a firing mechanism has a trigger housing having a front face, a rear face and a top face extending between the front face and rear face. First and second fixation apertures to facilitate securing of the trigger housing with a firearm receiver are provided adjacent the top face, and front and rear faces respectively. An elongate pivoting sear arm has a pivot end pivotally connected with the housing adjacent the rear and top faces, and a distal end including a trigger sear. The sear arm includes a striker sear that projects upwardly and projects rearwardly.

20 Claims, 5 Drawing Sheets

TRIGGER DEVICE

FIELD OF TECHNOLOGY

The present technology relates to a firearm trigger device that is selectively connectable with a firearm.

BACKGROUND TO THE TECHNOLOGY

Trigger pull is important as any movement of the firearm caused by pulling the trigger can affect the placement of the shot and, amongst other factors, consistent trigger pull increases shooting accuracy. Typical trigger pull force values lie between 3 and 6 pounds (lb.). Many competition style trigger mechanisms come with an adjustable bias to allow the shooter to adjust trigger pull force to desired levels.

OBJECT OF THE TECHNOLOGY

It is an object of the technology to provide a firearm trigger device that is selectively connectable with a firearm.

Additionally or alternatively, it is an object of the technology to provide a firearm trigger device with trigger pull characteristics that offer a firearm user with a useful alternative.

Additionally or alternatively, it is an object of the technology to provide a sear arm for a firearm trigger device.

Additionally or alternatively, it is an object of the technology to provide a trigger lever biasing mechanism for a firearm trigger device.

Additionally or alternatively, it is an object of the technology to provide a trigger safety mechanism for a firearm trigger device.

Additionally, or alternatively, it is an object of the technology to at least provide the public with a useful choice.

SUMMARY OF THE TECHNOLOGY

According to one example of the technology there is provided a trigger device for mounting with a firearm receiver containing a firing mechanism, the trigger device including:

- a trigger housing having a front face, a rear face and a top face extending between the front face and rear face,
- a first fixation aperture to facilitate securing of the trigger housing with a firearm receiver, the first fixation aperture adjacent the front face and adjacent the top face,
- a second fixation aperture to facilitate securing of the trigger housing with a firearm receiver, the second fixation aperture adjacent the rear face and adjacent the top face,
- an elongate pivoting sear arm, and
- a trigger lever having an engagement end for selectively engaging the trigger sear, In some examples the sear arm has a pivot end pivotally connected with the housing adjacent the rear face and adjacent the top face, and a distal end opposite the pivot end, the distal end of the sear arm including a trigger sear, and a striker sear projecting upwardly from the sear arm, wherein the sear arm is pivotable between a captured position wherein the striker sear protrudes above the top face and a released position where the striker sear is withdrawn below the top face, and wherein the striker sear projects upwardly and projects rearwardly.

In some examples the sear arm pivot end is pivotally connected concentric with the second fixation aperture.

In some examples the second fixation aperture is a rear fixation aperture to facilitate securing of the trigger device with a rearward fixation point of a firearm receiver, and the sear arm pivots about the rear fixation aperture.

In some examples the captured position the striker sear is engageable by a firing mechanism with a resultant engagement force, and wherein a vector of the engagement force lies entirely above the sear arm pivot.

In some examples the sear arm pivot end is pivotally connected concentric with the second fixation aperture, and the distal end extends to a position closer to the front face than to the pivot, or to a position closer to the first fixation aperture than to the pivot.

In some examples the trigger lever is pivotally connected with the housing adjacent a bottom face of the housing and extends from the pivot to a trigger lever distal end including the trigger sear and includes a trigger blade extending from the pivot below the bottom face.

In some examples a center of mass of the trigger lever is located at the pivot axis of the trigger lever.

In some examples the device includes a trigger biasing bar having a first end and a second end, the first end including a first spring connected with the trigger lever, the second end including a second spring connected with the housing, and a biasing screw engaging the bar between the first and second ends.

In some examples the biasing screw is adjustable to provide a selectable biasing force to the bar, and wherein the bar exerts a tension force on the first and second spring.

In some examples the biasing screw includes a bar engagement interface, the bar engagement interface including a plurality of detent positions for selectively receiving the bar.

In some examples the first fixation aperture has an elongated aperture profile.

In some examples the device further includes a safety lever, the safety lever including a first trigger blocking lever, a second sear arm blocking lever, and a safety blocking position, and wherein in the safety blocking position the safety lever simultaneously blocks the trigger lever and the sear arm.

In some examples the trigger lever includes an integral trigger blade, and the trigger lever directly engages the sear arm without intervening levers.

Further examples of the technology, which should be considered in all its novel examples, will become apparent to those skilled in the art upon reading of the following description which provides at least one example of a practical application of the technology.

BRIEF DESCRIPTION OF THE DRAWINGS

One or more embodiments of the technology will be described below by way of example only, and without intending to be limiting, with reference to the following drawings, in which.

DETAILED DESCRIPTION OF PREFERRED EXAMPLE OF THE TECHNOLOGY

Figure 2:
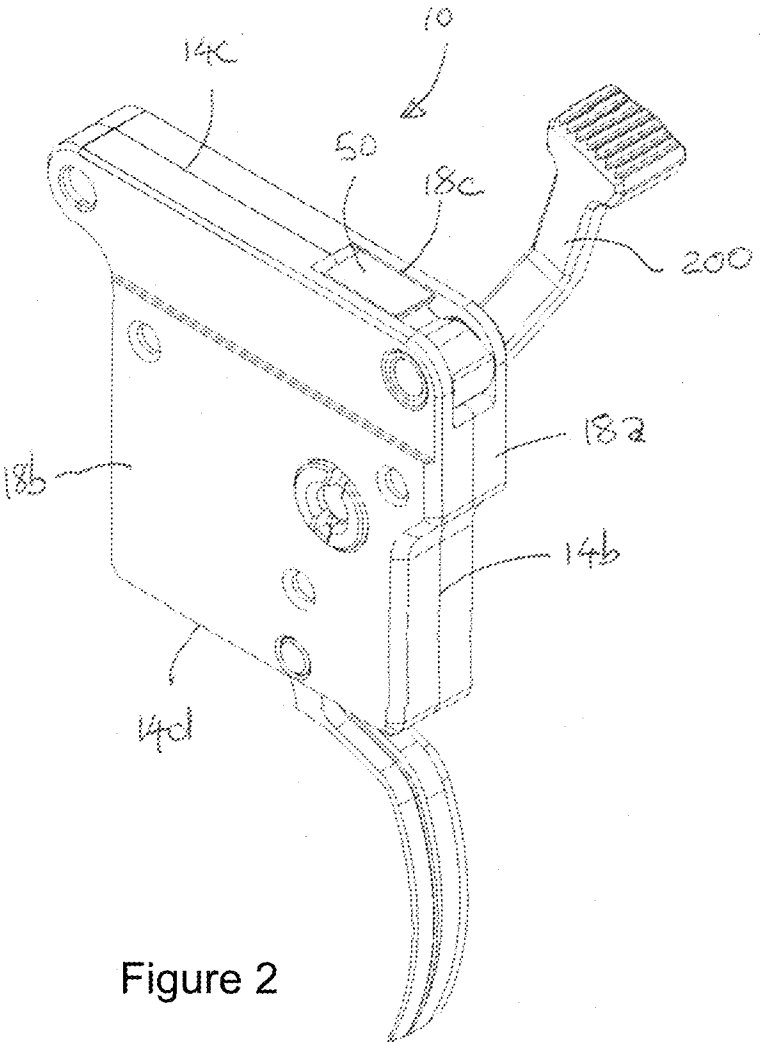
FIG. 2 is a rear perspective view of a trigger mechanism.
Figure 1:
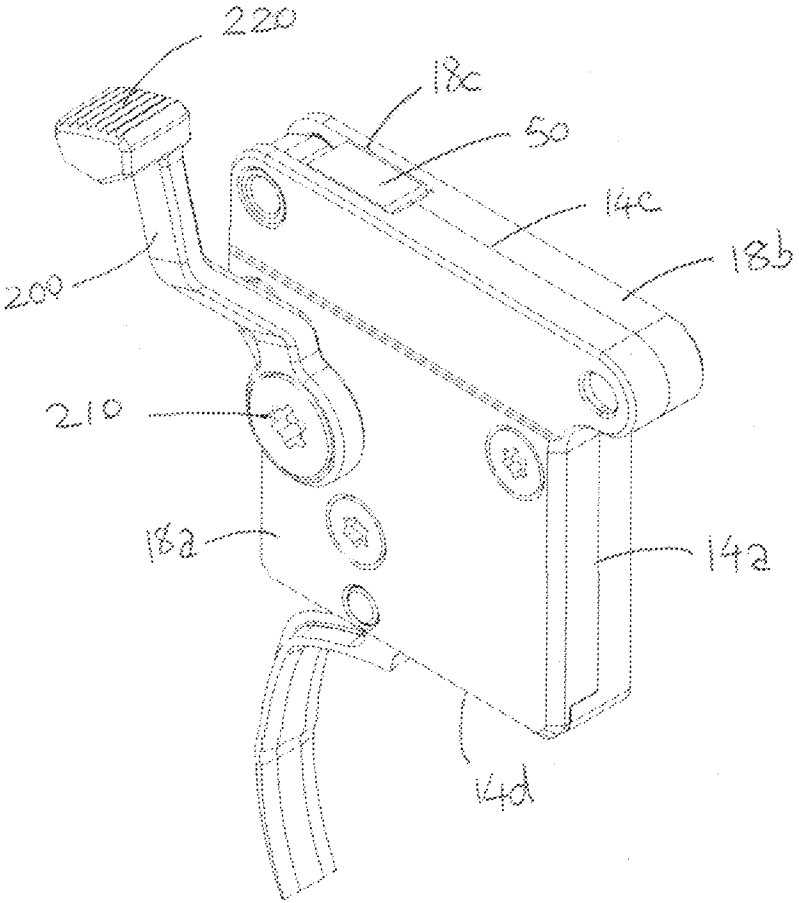
FIG. 1 is a front perspective view of a trigger mechanism according to examples of the invention.

Interpretations:

Throughout the description and the claims, unless the context clearly requires otherwise: —

- 'Firearm' and like terms mean a device that fires a projectile including, but are not limited to, a rifle, a pistol, a gun, a bow, or a crossbow.
- 'Receiver' or 'frame' and like terms mean a part of a firearm that provides a housing for receiving or mounting operating parts of the firearm including, but not limited to, a firing mechanism and trigger mechanism.
- 'Firing mechanism', or 'firing pin', or 'striker' and like terms mean a device that initiates discharging of a projectile, and in the case of a bow or crossbow, includes an elastic launching device (e.g., a string or bowstring).
- 'Trigger', or 'trigger device', or 'trigger mechanism' and like terms mean a device for actuating a firing mechanism or, in the case of a bow or crossbow, for releasing an elastic launching device.
- 'Blade' or 'trigger blade' and like terms mean the part of a trigger mechanism to which pressure is applied by the user to cause the trigger to activate a firing mechanism or, in the case of a crossbow, to release a string.
- 'Sear' and like terms mean a part of a trigger mechanism that holds back or captures a firing mechanism, or string, until an amount of pressure has been applied to the trigger blade: upon which the sear activates or releases the firing mechanism or string. A trigger may include any number of sears which may act individually to hold back or restrain different firing mechanisms or distinct stages of a firing mechanism, or which may act simultaneously to activate or release the firing mechanism.
- 'Forward', 'front' and like terms are to be construed, in the content of a firearm or firearm component, as being in the direction in which the projectile (bullet or arrow) travels after discharge or release.
- 'Rearward', 'rear', and like terms are to be construed, in the content of a firearm or firearm component, as being in the direction opposite to that in which the project travels after discharge or release.
- 'Up', or 'Upwardly', or 'upper', or 'top', or 'above', and like terms are to be construed, in the content of a firearm or firearm component, when the firearm or component is in a conventionally intended orientation for firing of a projectile, although it is understood that the firearm may be held and fired in a number of different rotational orientations. Likewise, 'down', or 'downwardly', or 'lower', or 'bottom', or 'below' and like terms are to be construed, in the content of a firearm or firearm component, when the firearm or component is in a conventionally intended orientation for firing of a projectile, although it is understood that the firearm may be held and fired in a number of different rotational orientations.
- 'Vector', or 'force vector' means a straight line of infinite length coincident with all points in the direction of a force quantity irrespective of the magnitude of the force.

Description Some Examples

In the drawings there is depicted a trigger device 10 that mounts to a receiver 130, or frame part, of a firearm containing a firing mechanism. The trigger device includes a sear arm 50 for selectively holding back a firing pin of the firing mechanism, and a trigger lever 30 that can be manipulated by a firearm user for allowing the sear arm 50 to selectively release the firing pin of the firing mechanism. The trigger lever includes an integral trigger blade and directly engages the sear arm without intervening levers or mechanisms.

The trigger device 10 includes a housing 12 having a front face 14*a*, a rear face 14*b*, a top face 14*c* extending between the front face 14*a* and rear face 14*b*, and a bottom face 14*d* opposite the top face 14C. In the drawings and description, the front face 14*a* is the face of the trigger housing that, when correctly assembled with a firearm, is the face facing the direction D1 of intended travel of the projectile (for example bullet) fired by the firearm. The top or top face 14*c* of the housing 12 is the face closest or adjacent to the firing mechanism and/or pin and/or receiver, which in conventional examples is the top face when the firearm is held in an intended orientation for firing of a projectile, notwithstanding that it is understood that a firearm may be held and fired in a number of different rotational orientations, for example rotated 90-degrees or rotated 180-degrees. The housing 12 has a first fixation aperture 16*a* to facilitate securing of the trigger housing 12 with a forward fixation point 130*a* of a firearm receiver 130. The first fixation aperture 16*a* is front fixation aperture adjacent the intersection of the front face 14*a* and the top face 14*c* of the trigger housing. The housing 12 has a second fixation aperture 16*b* to facilitate securing of the trigger housing with a rearward fixation point 130*b* of a firearm receiver 130. Conventionally, the second fixation aperture 16*b* is a rear fixation aperture provided adjacent an intersection of the rear face 14*b* and the top face 14*c*. In some examples the first fixation aperture 16*a* has an elongated aperture profile. Each manufacturer has its own receiver pin bore spacing and the exact dimension and tolerances of the receiver bores might not be public knowledge. This results in different triggers with different pin hole spacing and hole size, for example, some triggers have 3.200 mm holes, others have 3.175 mm holes. The hole spacing can also differ as much as 0.200 mm. The elongate profile of first fixation aperture 16*a* allows the trigger mechanism to be easily fitted with receivers with slight variations in distance between fixation points 130*a* and 130*b*. The trigger 10 is secured with the receiver 130 using fixing pins 131*a*, 131*b* that pass through respective fixation points and apertures.

Figure 3:
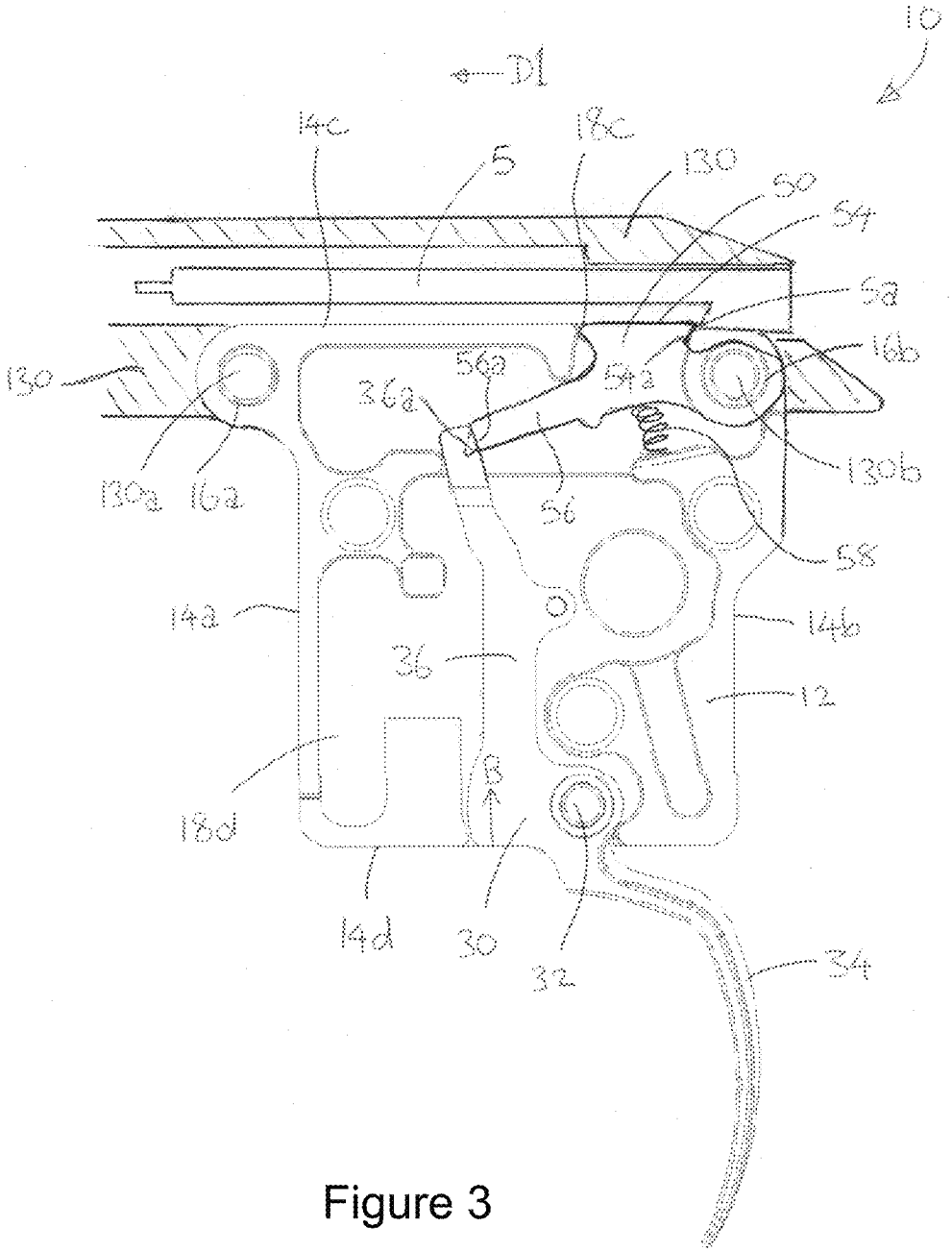
FIGS. 3-7 are cross-section views of the trigger mechanism and trigger components in various safety and firing configurations.

In preferred examples, although not exclusively, the trigger housing 12 is constructed of two lateral clamshell halves 18*a* and 18*b*. Mating faces of the two clamshell halves 18*a* and 18*b* have recessed portions which, when the clamshell halves 18*a* and 18*b* are brough together define an interior space or spaces 18*d* of the housing 12 for accommodating various components of the trigger mechanism 10. The top face 14*c* of the housing has an opening 18*c* into which is positioned the sear arm 50 for selectively holding back a firing pin of the firing mechanism. The sear arm 50 has a pivot end 52 pivotally connected with the housing adjacent the rear face 14*b* and adjacent the top face 14*c* of the housing 12. In some examples the sear arm pivot end 52 is pivotally connected concentric with the second fixation aperture 16*b* to pivot about fixation aperture 16*b*. In this example the sear arm pivot end 52 has a generally annular shape about the second fixation aperture 16*b* such that the second fixation aperture 16*b* defines a pivot point for the sear arm 50. The sear arm 50 includes an upper surface 54 which in one pivot position of the sear arm 50 is selectively generally planar with the housing top face 14*c*. This is a capture position (shown in FIGS. 3 and 4 for example) in which a rearward face 54*a* of the sear arm upper surface 54 defines a striker sear which is selectively engageable by an engagement face 5*a* for holding back a firing pin 5. In the captured position, the striker sear projects upwardly above the top face 14*c* and rearwardly relative to the front face 14*a*.

Figure 5:
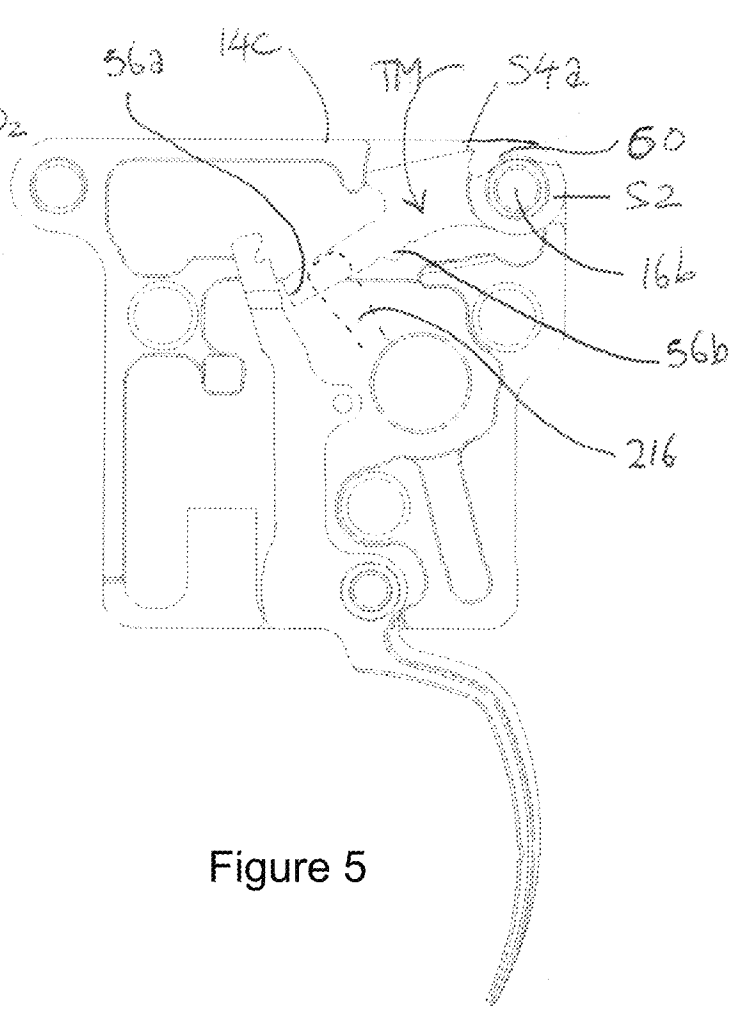

The sear arm 50 includes a control portion 56 extending within the internal space 18*d* of the trigger housing. A distal end 56*a* of the control portion 56 defines a trigger sear, which as described below is selectively engageable with the trigger lever 30. When the trigger sear is not engageable with the trigger lever 30 the sear arm 50 is free to pivot in a direction turning moment TM about its pivot point (defined by second fixation aperture 16*b*) to a release position where the striker sear 54*a* is allowed to withdraw below the top face 14*c* where it will disengage from a firing mechanism. The released position is generally shown in FIG. 5. A biasing spring 58 is provided within the housing to bias the sear arm 50 in to the capture position. The biasing spring may be a coil spring as depicted in the drawings or a torsion spring about the pivot/fixation aperture 16*b*. The biasing force required is sufficient to return the sear arm 50 to the capture position but be readily overcome by an engagement force of a firing mechanism with the striker sear 54*a*.

A trigger lever 30 is pivotally connected with the trigger housing 12 adjacent to the bottom face 14*d*. A trigger blade 34 extends from the trigger pivot 32 below the bottom face 14*d* where it is selectively engageable by a firearm user. The trigger lever 30 also includes a trigger arm 36 extending into the interior space 18*d* of the housing to a distal end 36*a* that is selectively engageable by the trigger sear 56*a*. The trigger lever 30 is pivotal between a blocking position, shown in FIG. 3 for example, and a firing position shown in FIGS. 4 and 5. In the blocking position the distal end 36*a* of the trigger arm is selectively engageable by the trigger sear 56*a* such that the sear arm is prevented from pivoting from the capture position to the release position until the trigger blade 34 is "pulled" by a firearm user. When the trigger is 'pulled' the trigger lever 30 moves towards the firing position: as it does the trigger sear 56*a* disengages from the trigger arm 36/36*a* and the sear arm 50 is free to pivot from the capture position to the release position.

The trigger lever is provided with a bias force, notionally indicated by vector B spaced apart from the trigger pivot 32, towards the blocking position by a bias mechanism. Spacing apart of the bias force, notionally indicated by vector B, from the trigger pivot 32 causes a turning moment on the trigger lever 30. In some examples the bias force is provided by a selectively variable double-spring trigger bias mechanism 100 as discussed below. In some examples the trigger lever 30 has a center of mass, located at the trigger pivot 32.

Figure 4:
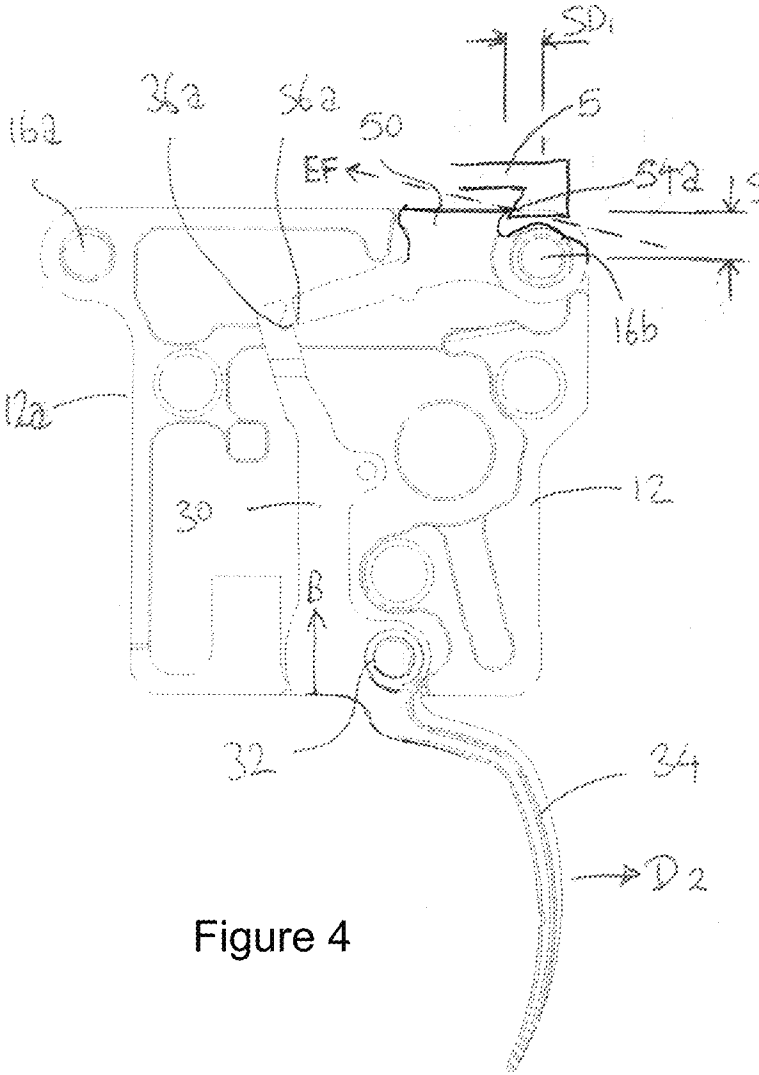

In FIG. 4 an engagement portion of a firing mechanism/pin is depicted by element 5. The engagement portion of a firing mechanism/pin engages on the striker sear 54*a* when the sear arm 50 is in the capture position and is biased to move in a firing direction, which in the illustrated example is in the direction D1 of intended travel of the projectile. The pivot end 52 of the sear arm has a cut-a-way portion 60, which together with the upper surface 54 defines a striker sear 54*a*. The position of the striker sear 54*a* can be defined by a first, notionally horizontal, distance SD1 between the striker sear 54*a* and sear arm pivot axis (notionally 16*b*) and a second, notionally vertical, distance SD2 between the striker sear 54*a* as defined by surface 54 and sear arm pivot axis (notionally 16*b*). In a preferred example the distance SD1 and SD2 are selected such that an engagement force of the engagement portion of the firing mechanism/pin 5 has a resultant engagement force vector EF, depicted by a broken line, that lies entirely above the sear arm pivot 16*b*. A resultant turning moment, depicted by curved arrow TM, wants to pivot the sear arm 50 towards the release position. In some examples the control arm 56 length positions the trigger sear 56*a* closer to the front face 12*a* than to the pivot 16*b*, or to a position closer to the first fixation aperture 16*a* than to the second fixation aperture 16*b*.

Figure 7:
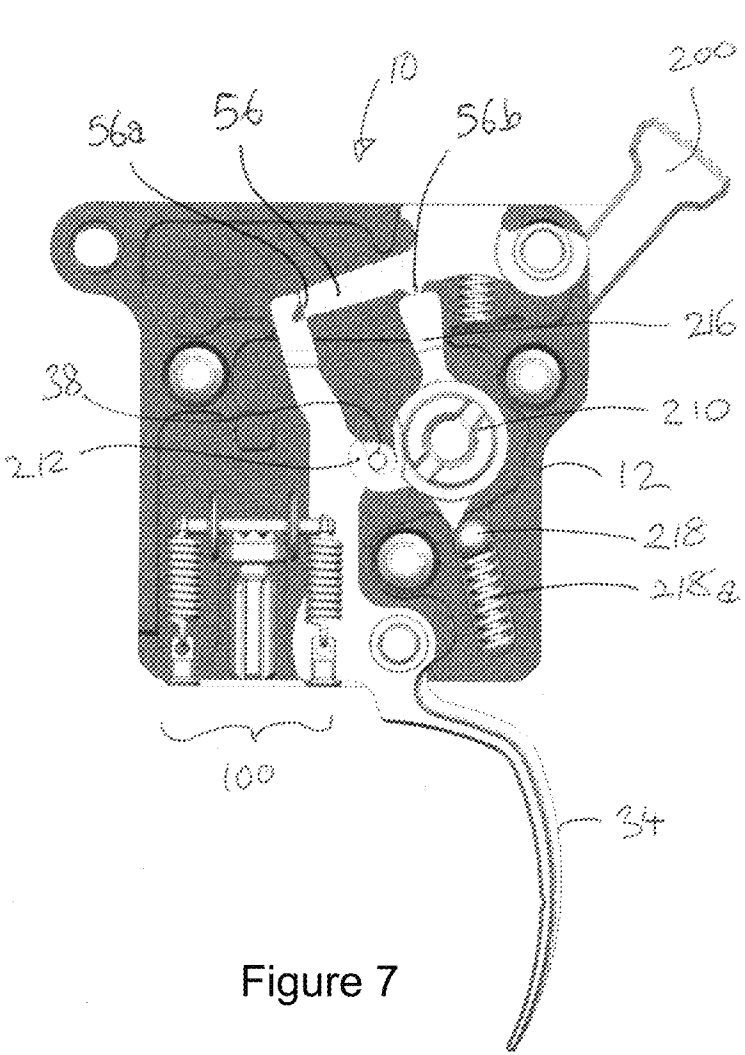
Figure 6:
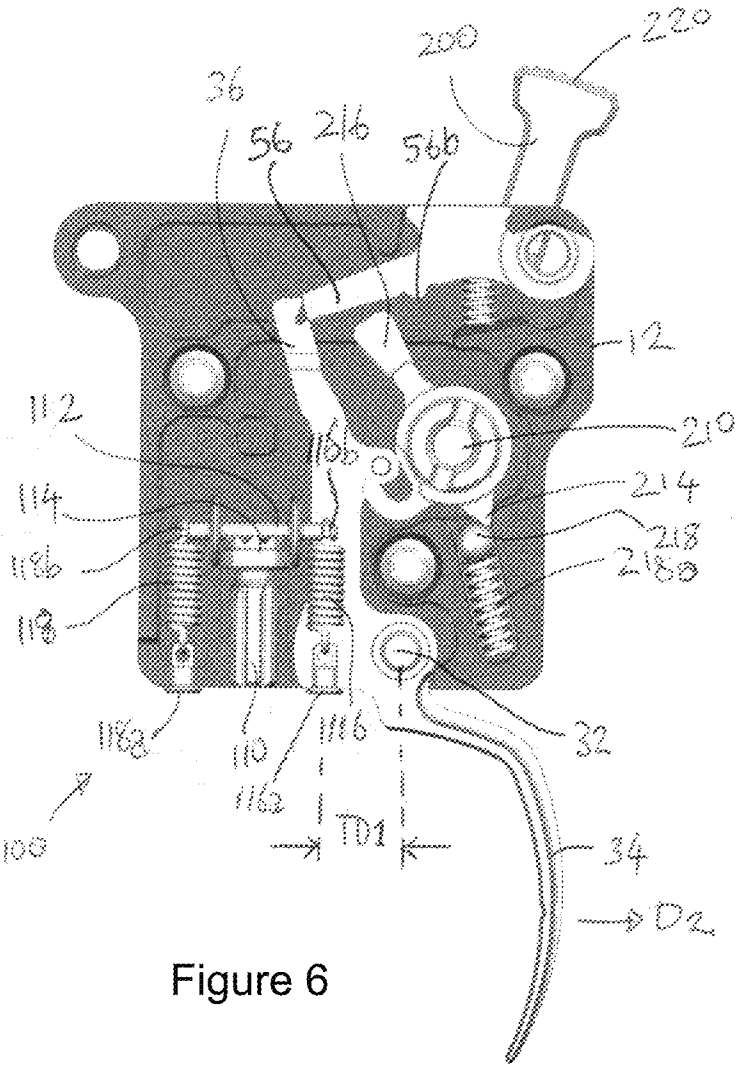
Figure 8:
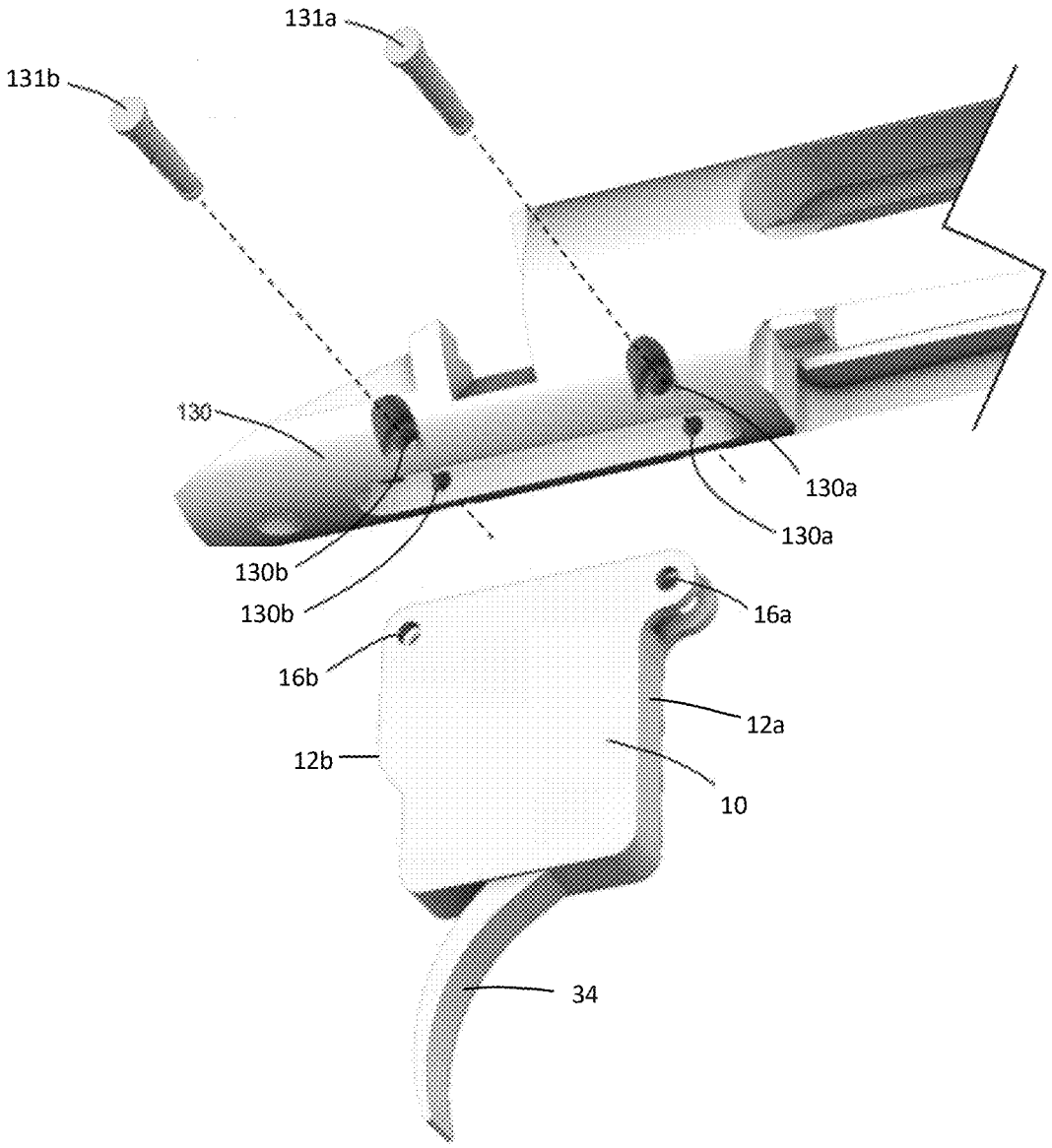
FIG. 8 is an exploded perspective view of the trigger mechanism and the receiver to which it mounts.

Trigger pull is the force required to move the trigger lever 30 and release the sear arm 50 to discharge the firearm. Trigger pull is important as any movement of the firearm caused by pulling the trigger can affect the placement of the shot and, amongst other factors, consistent trigger pull increases shooting accuracy. Typical trigger pull force values lie between 3 and 6 pounds (lb.). Many competition style trigger mechanisms come with an adjustable bias to allow the shooter to adjust trigger pull force to desired levels. In some examples of the invention a trigger bias force is provided by a selectively variable double-spring trigger bias mechanism 100 as illustrated in FIGS. 6 and 7.

The trigger bias mechanism 100 includes a screw body 110 axially aligned generally parallel with the trigger arm 36 extending into the interior space. An adjustment end of the screw body 110 is accessible via a port or aperture in the bottom wall 14*d* and is supported in a threaded bore of the housing 12. The adjustment end of the screw body 110 is provided with engagement means for an adjustment tool, which can accommodate, for example, any one of a flat blade, Phillips, torx, hex or square driver for rotation of the screw body 110. Rotation of the screw body 110 in a first, say conventionally clockwise, direction advances the screw body 110 in a first longitudinal direction along the threaded bore of the housing 12. In some examples the first longitudinal direction along the threaded bore is towards the top face 14*c* (or away from the bottom face 14*d*) of the housing 12. Rotation of the screw body 110 in a second, say conventionally anti-clockwise, direction advances the screw body 110 in a second longitudinal direction along the threaded bore of the housing 12. In some examples the second longitudinal direction along the threaded bore is away from the top face 14*c* (or towards the bottom face 14*d*) of the housing 12.

A distal end of the screw body 110, opposite the adjustment end, includes a bar support member 114 for supporting a bias bar 112. The bias bar 112 is supported generally on a central region of the bar 112. A first trigger biasing end 116*b* of the bar 112 extends laterally towards the trigger lever 30. A first trigger biasing spring 116 is supported between the trigger biasing end 116*b* of the bar 112 and a trigger biasing fixing 116*a* of the trigger lever. The trigger biasing fixing 116*a* is laterally spaced apart from the trigger lever pivot 32 by the trigger distance TD1. A second biasing spring 118 is affixed between a second end 118*b* of the bar 112 and a housing fixing 118*a* adjacent the bottom face 14*d* of the housing. Advancing the screw body 110 in the first direction increases a spring tension force on the springs 116 and 118. Advancing the screw body 110 in the second direction decreases a spring tension force on the springs 116 and 118. The bar support member 114 includes a plurality of radial teeth formed by grooves in an end face. The bar 112 engages with the grooves to define a plurality of rotational detent positions, each defining a different spring tension force on the springs 116 and 118. The detent positions act to reduce the tendency of the screw body 110 to unintentionally rotate, say due to vibrational forces, resulting in 'drifting' of a user-set spring tension force. The bar 112 is biased into engagement with the grooves by spring tension forces on both springs 116 and 118. The trigger lever 30 however, experiences only the spring tension force of trigger biasing spring 116. As a result, the trigger lever can be more lightly biased while maintaining a greater bias on the bar 112/groove engagement to help resist unintentional drift of the screw body 110 setting.

In some examples the trigger mechanism 10 includes safety lever 200 that has a first trigger blocking lever and a second sear arm blocking lever. The safety lever 200 can be moved between a firing position and a safety blocking position in which the safety lever simultaneously blocks the trigger lever and the sear arm. The safety lever 200 includes a pivotal hub portion 210 partially affixed through the side wall of one clamshell housing halve 18*b*. The lever 200 includes a knurled head 220 at the end distal from the hub 210. The knurled head is operable by a user to rotate the hub 210 via the lever 200. Internal to the housing the hub 210 includes a hook shaped trigger blocking lever 212 extending axially from the hub to a position to selectively engage a blocking pin 38 of the trigger lever 30. The hub also internally includes an axially extending sear arm blocking lever 216 that selectively engages the sear arm 50. The hub also internally includes an axially extending detent perturbance 214 that selectively engages one of two rotational positions of the safety lever, namely a firing position and a safety blocking position. A detent ball 218 and detent ball spring 218*a* are provided in a bore of the housing.

The axially extending detent perturbance 214 engages the ball at the opening of the housing and rides over the ball 218 between the two detent positions. When the safety lever 200 is in a firing position, for example FIG. 6, the trigger can be pulled to release the sear arm 50 resulting in discharge of the firearm. When the safety lever 200 is in a safety blocking position, for example FIG. 7, the trigger blocking lever 212 and a sear arm blocking lever 216 simultaneously blocks the trigger lever and the sear arm, preventing discharge of the firearm. The control arm 56 includes a center aperture between the trigger sear 56*a* and a safety blocking point 56*b*. When the safety lever 200 is in a firing position and the sear arm 50 is released the blocking lever 216 can pass into/through the control arm 56 center aperture so that it does not impede pivoting of the sear arm 50 (see 216 in broken lines in FIG. 5).

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The technology may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the technology and without diminishing its attendant advantages. It is therefore intended that such changes and modifications be included within the present technology.

What is claimed is:

1. A trigger device for mounting with a firearm receiver containing a firing mechanism, the trigger device including:

a trigger housing having a front face, a rear face and a top face extending between the front face and rear face, a first fixation aperture to facilitate securing of the trigger housing with a firearm receiver, the first fixation aperture adjacent the front face and adjacent the top face, a second fixation aperture to facilitate securing of the trigger housing with a firearm receiver, the second fixation aperture adjacent the rear face and adjacent the top face, an elongate pivoting sear arm, the sear arm having a pivot end pivotally connected with the housing adjacent the rear face and adjacent the top face, and a distal end opposite the pivot end, the distal end of the sear arm including a trigger sear, a striker sear projecting upwardly from the sear arm, a trigger lever having an engagement end for selectively engaging the trigger sear, the sear arm pivotable between a captured position wherein the striker sear protrudes above the top face and a released position where the striker sear is withdrawn below the top face, and wherein the striker sear projects upwardly and projects rearwardly.

2. The trigger device of claim 1, wherein the sear arm pivot end is pivotally connected concentric with the second fixation aperture.

3. The trigger device of claim 1, wherein second fixation aperture is a rear fixation aperture to facilitate securing of the trigger device with a rearward fixation point of a firearm receiver, and the sear arm pivots about the rear fixation aperture.

4. The trigger device of claim 1, wherein in the captured position the striker sear is engageable by a firing mechanism with a resultant engagement force, and wherein a vector of the engagement force lies entirely above the sear arm pivot.

5. The trigger device of claim 1, wherein the sear arm pivot end is pivotally connected concentric with the second fixation aperture, and the distal end extends to a position closer to the front face than to the pivot, or to a position closer to the first fixation aperture than to the pivot.

6. The trigger device of claim 1, wherein the trigger lever is pivotally connected with the housing adjacent a bottom face of the housing and extends from the pivot to a trigger lever distal end including the trigger sear and includes a trigger blade extending from the pivot below the bottom face, and wherein a center of mass of the trigger lever is located at the pivot axis of the trigger lever.

7. The trigger device of claim 6, further including a trigger biasing bar having a first end and a second end, the first end including a first spring connected with the trigger lever, the second end including a second spring connected with the housing, and a biasing screw engaging the bar between the first and second ends.

8. The trigger device of claim 7, wherein the biasing screw is adjustable to provide a selectable biasing force to the bar, and wherein the bar exerts a tension force on the first and second spring.

9. The trigger device of claim 7, wherein the biasing screw includes a bar engagement interface, the bar engagement interface including a plurality of detent positions for selectively receiving the bar.

10. The trigger device of claim 1, wherein the first fixation aperture has an elongated aperture profile.

11. The trigger device of claim 1, further including a safety lever, the safety lever including a first trigger blocking lever, a second sear arm blocking lever, and a safety blocking position, and wherein in the safety blocking position the safety lever simultaneously blocks the trigger lever and the sear arm.

12. The trigger device of claim 1, wherein the trigger lever includes an integral trigger blade, and the trigger lever directly engages the sear arm without intervening levers.

13. A trigger device for mounting with a firearm receiver containing a firing mechanism, the trigger device including:

a trigger housing having a front face, a rear face and a top face extending between the front face and rear face, a first fixation aperture to facilitate securing of the trigger housing with a firearm receiver, the first fixation aperture adjacent the front face and adjacent the top face, a second fixation aperture to facilitate securing of the trigger housing with a firearm receiver, the second fixation aperture adjacent the rear face and adjacent the top face, an elongate pivoting sear arm, the sear arm having a pivot end pivotally connected with the housing adjacent the rear face and adjacent the top face, and a distal end opposite the pivot end, the distal end of the sear arm including a trigger sear, a striker sear projecting upwardly from the sear arm, a trigger lever having an engagement end for selectively engaging the trigger sear, the sear arm pivotable between a captured position wherein the striker sear protrudes above the top face and a released position where the striker sear is withdrawn below the top face, and wherein in the captured position the striker sear is engageable by a firing mechanism with a resultant engagement force, and wherein a vector of the engagement force lies entirely above the sear arm pivot.

14. The trigger device of claim 13 wherein the sear arm pivot end is pivotally connected concentric with the second fixation aperture.

15. The trigger device of claim 13 wherein second fixation aperture is a rear fixation aperture to facilitate securing of the trigger device with a rearward fixation point of a firearm receiver, and the sear arm pivots about the rear fixation aperture.

16. The trigger device of claim 13 wherein the sear arm pivot end is pivotally connected concentric with the second fixation aperture, and the distal end extends to a position closer to the front face than to the pivot, or to a position closer to the first fixation aperture than to the pivot.

17. The trigger device of claim 13 wherein the trigger lever is pivotally connected with the housing adjacent a bottom face of the housing and extends from the pivot to a trigger lever distal end including the trigger sear and includes a trigger blade extending from the pivot below the bottom face, and wherein a center of mass of the trigger lever is located at the pivot axis of the trigger lever.

18. The trigger device of claim 17 including a trigger biasing bar having a first end and a second end, the first end including a first spring connected with the trigger lever, the second end including a second spring connected with the housing, and a biasing screw engaging the bar between the first and second ends.

19. The trigger device of claim 18 wherein the biasing screw is adjustable to provide a selectable biasing force to the bar, and wherein the bar exerts a tension force on the first and second spring.

20. The trigger device of claim 18 wherein the biasing screw includes a bar engagement interface, the bar engagement interface including a plurality of detent positions for selectively receiving the bar.

* * * * *